US006566620B1

(12) United States Patent
Lohmann

(10) Patent No.: US 6,566,620 B1
(45) Date of Patent: May 20, 2003

(54) METHOD FOR SORTING MAIL ITEMS

(75) Inventor: Boris Lohmann, Bremen (DE)

(73) Assignee: Siemens Atkiengsellschaft, München (DE)

( * ) Notice: Subject to any disclaimer, the term of this patent is extended or adjusted under 35 U.S.C. 154(b) by 0 days.

(21) Appl. No.: 09/485,185

(22) PCT Filed: Aug. 6, 1997

(86) PCT No.: PCT/DE97/01661

§ 371 (c)(1),
(2), (4) Date: Feb. 7, 2000

(87) PCT Pub. No.: WO99/07487

PCT Pub. Date: Feb. 18, 1999

(51) Int. Cl.[7] ..... B07C 5/00; B65H 83/00
(52) U.S. Cl. ..... 209/584; 209/900; 271/3.14
(58) Field of Search ..... 209/576, 583, 209/584, 900; 271/3.01, 3.14

(56) References Cited

U.S. PATENT DOCUMENTS 5,031,223 A * 7/1991 Rosenbaum et al. .... 209/584 X
5,287,271 A 2/1994 Rosenbaum ..... 700/224 X
5,433,325 A * 7/1995 Levaro et al. ..... 209/900 X

FOREIGN PATENT DOCUMENTS

| | | | |
|---|---|---|---|
| DE | 24 43 418 | 3/1976 | |
| DE | 296 14 914 | 10/1996 | |
| EP | 0 140 760 | 5/1985 | |
| EP | 566 456 | * 10/1993 | ..... 209/584 |
| EP | 0 684 086 | 11/1995 | |

* cited by examiner

*Primary Examiner*—Tuan N. Nguyen
(74) *Attorney, Agent, or Firm*—Venable; Robert Kinberg; Catherine M. Voorhees

(57) ABSTRACT

The invention concerns a method for sorting mail items, said sorting being carried out base on characteristics located on the face of the mail items and by a sorting machine which sorts said explored and recognized characteristics. In order to ensure continuous final sorting in a sorting machine whereof the number of separation racks is less than the number of final directions, the input mail items are pre-sorted according to a pre-sorting plan. Simultaneously, final sorting operations are executed on the machine, the pre-sorted mail items being re-inserted in the sorting machine to be subjected therein to a final sorting.

13 Claims, 3 Drawing Sheets

METHOD FOR SORTING MAIL ITEMS

BACKGROUND OF THE INVENTION

The invention relates to a method for sorting mail items with the aid of characteristics on the mail item surface and by using a sorting machine, which sorts the items on the basis of these scanned and recognized characteristics.

One or more of the following problems can occur when sorting mail items on the basis of characteristics on the mail item surface to a high number of sorting directions:

Sorting machines with the required number of separation racks are not available;

Not enough space is available for correspondingly large sorting machines;

Correspondingly large sorting machines are too expensive.

According to prior art, mail items are therefore distributed as follows to a large number of sorting directions by using smaller sorting machines:

Variant 1:

Several (n pieces) smaller sorting machines are used. The first machine is used for a presorting according to a sorting plan A with n-1 target directions. The presorted mail items are then sorted for the final direction in the additional n-1 sorting machines, based on sorting plans 1 to n-1. The total number of possible sorting lines equals the sum of the separation racks of machines 2 to n. The use of this variant has advantages only if the volume of mail items is high enough, so that the n machines are used to capacity. If this is not the case, another variant offers itself:

Variant 2:

For this, all n sorting plans, meaning the presorting plan and the final sorting plans, are executed one after another on a single sorting machine. In the first step, all mail items are therefore presorted according to plan A for the respective final sorting plan and are then stored (e.g. in boxes). In additional sorting runs, the mail items are again fed to the sorting machine from the mail item storage magazines and are sorted for the final sorting directions.

The disadvantages of variant 2 include:

All mail items must first pass through step 1 before the step 2 can be started. Thus, the preparation must be completed before the final sorting can start. This is a problem with respect to the postal operation since mail items generally arrive distributed throughout the day at the sorting center. The final sorting in this case cannot be started until very late, wherein the time required for the final sorting process is long.

The last mail items sorted to the final direction are those of sorting plan n-1. Thus, any of the following possible processing steps (such as shipping, delivery or the like) for these mail items cannot take place until all other mail items have been sorted.

The intermediate storage of the mail items between presorting and sorting to the final direction is unfavorable for reasons of space and organization.

SUMMARY OF THE INVENTION

It is the object of the invention to create a sorting process, which permits a continuous sorting to the final direction on a single sorting machine, wherein the number of final directions is higher than the number of separation racks for the machine.

This object is solved according to the invention by simultaneously presorting and sorting to the final direction on only one sorting machine. This method has the following advantages:

The total required processing time is shorter than if the sorting plans are processed one after another since the full separation rack capacity is used continuously.

The scope of required mail item storage magazines is small.

The sorting machine can be supplied continuously with new, unsorted mail items.

In an advantageous embodiment according to the invention, all incoming mail items are presorted. The mail items presorted for the active final sorting plans are again fed into the sorting machine. The mail items are distributed according to presorting and final sorting plans, either through manual input of the operator or through marking the mail items during the presorting, which then allows an automatic assignment to a final sorting plan during the second sorting run. A bar code is used, for example, for this marking, which can be printed on as address code after the address is read and recognized.

Based on another advantageous embodiment according to the invention, incoming mail items, which must be sorted according to the respectively active final sorting plans, are sorted immediately without presorting. The remaining mail items are presorted.

According to yet another embodiment of the invention, the mail items respectively sorted to the final direction, with the associated activated final sorting plans, are advantageously selected on the basis of the mail item frequency or based on operational aspects.

Furthermore, it is advantageous if separate input stations are provided for mail items that are unsorted and items that are presorted and fed back. In that case, the input station for the unsorted mail items is provided with an address reader for recognizing the address and a code printer for printing on a code that marks the recognized address. Also, the input station for presorted mail items that are fed back is provided only with a code reader. In addition to saving costs, this also permits an automatic feeding of the mail items into the machine; e.g. the presorted mail items are fed back only if unsorted mail items are not available at the moment.

It is furthermore favorable if knowledge of the actual statistical distribution of mail items to the sorting directions is used to modify the final sorting plans. As a result, frequently used separation racks can be placed in locations, for example, which are favorable from a transport-technical point of view, or possibly existing reserve separation racks can additionally be assigned to high use directions to avoid or delay an overflow in the sorting compartments.

BRIEF DESCRIPTION OF THE DRAWINGS

The invention is explained in further detail in the following with the aid of the drawings in which.

DETAILED DESCRIPTION OF THE INVENTION

The process is explained with an example for sorting to 1000 final destinations by using a sorting machine with only 205 sorting racks.

Figure 1:
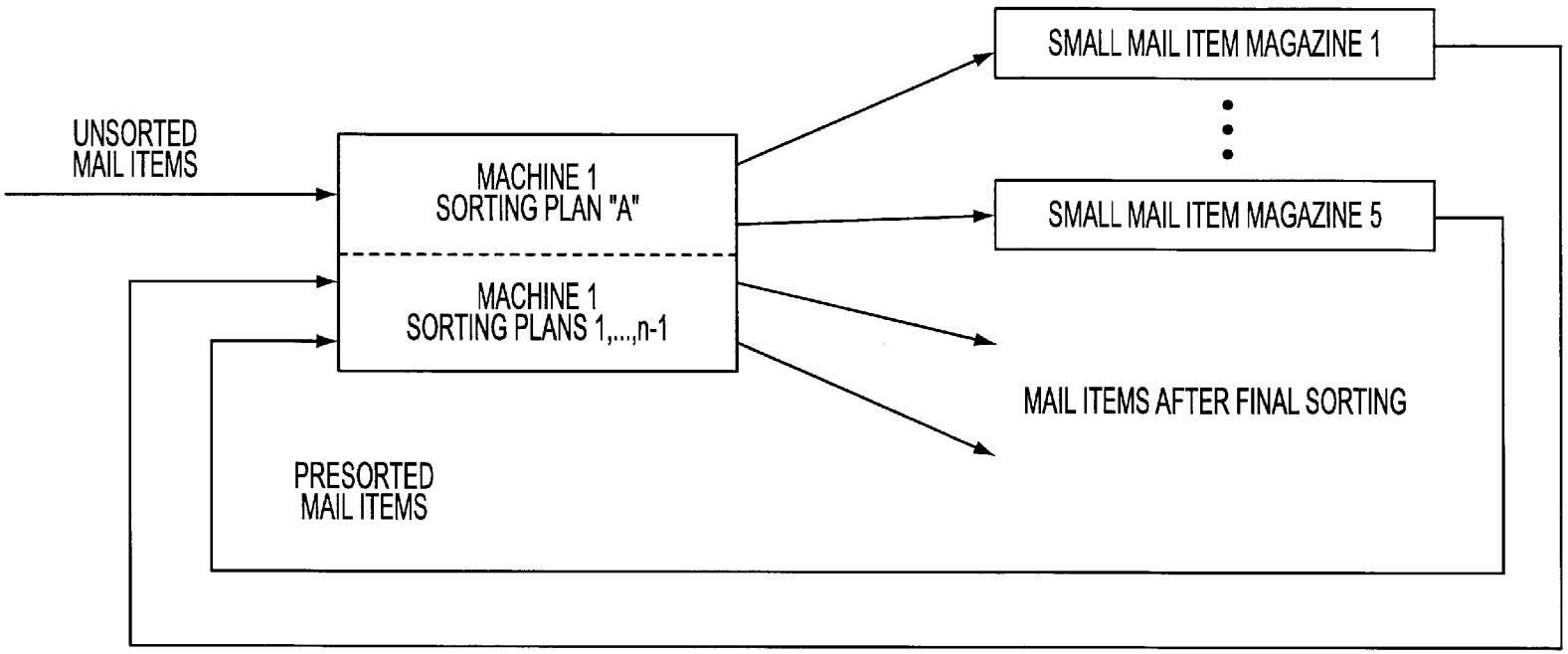
FIG. 1 is a basic representation of the process sequence.

The mail items are fed to a machine and are initially presorted to 5 directions according to a sorting plan A, namely to the 5 following finals sorting plans. The presorted mail items are then stored temporarily in 5 smaller mail item storage magazines (FIG. 1).

At the same time, one of the 5 final sorting plans with respectively 200 sorting destinations is activated, e.g. final sorting plan 1. The presorted mail items are then fed from the item storage magazine 1 back into the machine, as often as possible from an operational point of view, and are sorted to the 200 associated separation racks. If the mail item storage magazine 1 is empty, a changeover to the final sorting plan 2 occurs and the items are sorted to the next 200 destinations. At the same time, new and unsorted mail items can be fed in continuously. These are then presorted as previously described to 5 directions and according to sorting plan A. With the aid of the bar code during the final sorting on the basis of the read and recognized address, the sorting machine can assign the respectively active final sorting plan to the mail items that are fed back in. Since two sorting plans (sorting plan A and one of the sorting plans 1–5) are always active according to this strategy, a double sorting of the mail items can be avoided for ⅕ of the mail items in that the respective unsorted mail items are no longer presorted, but are assigned directly to the active final sorting plan.

Figure 2:
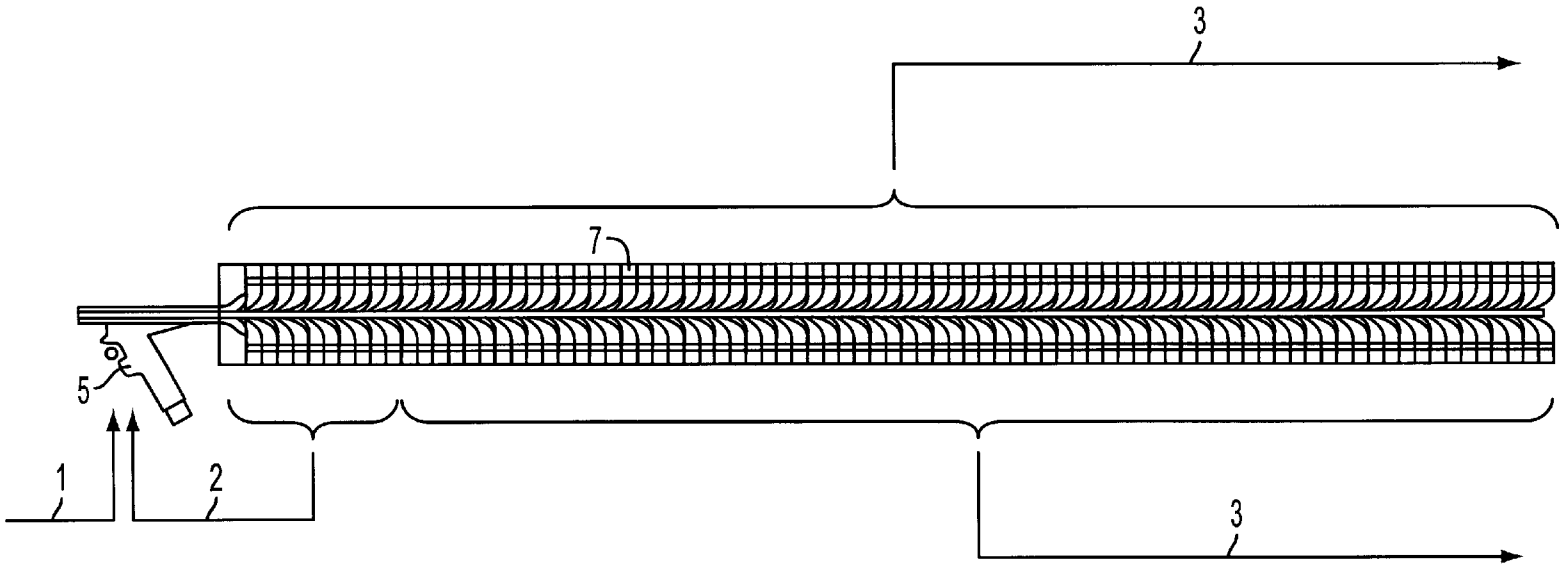
FIG. 2 is a basic representation of a sorting installation for large envelopes, comprising a manual input station.

FIG. 2 shows the use of the method for a large envelope sorting facility with a plurality of racks 7, to which the large envelopes are distributed. The facility also comprises a manual input station 5 and further uses an address reader and code printer. The unsorted mail items 1 are moved via the manual input station 5 to the machine where they are presorted according to the existing final sorting plans. From the magazines provided for this purpose, the presorted mail items 2 are again supplied to the machine by way of an intermediate storage magazine, which is not shown here, and the input station 5 and are then sorted according to the current final sorting plan. These mail items sorted to the final direction are then located in all racks except for the presorting racks. The racks must be emptied completely for each new final sorting plan. Mail items for the current final sorting plan can also be sorted to go directly to the respective final sorting racks.

Figure 3:
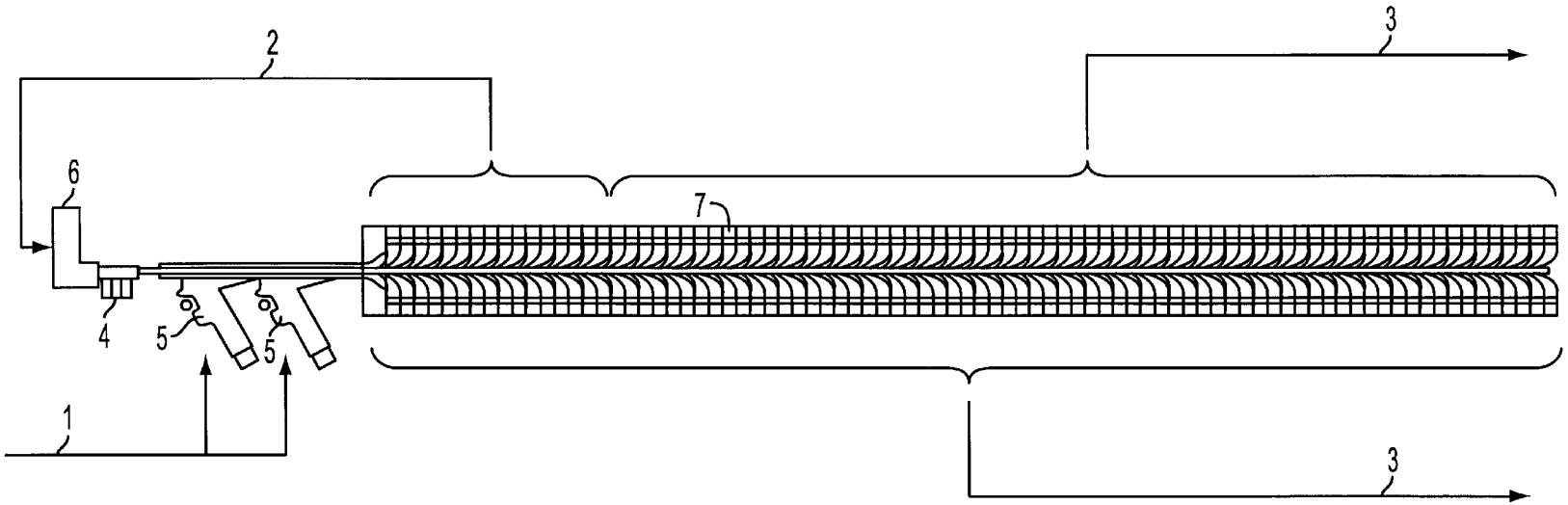
FIG. 3 is a basic representation of a sorting installation for large envelopes, comprising a manual and an automatic input station.

The sorting of mail items, which involves large envelopes in this case, is particularly advantageous if several input stations exist (FIG. 3).

The unsorted mail items 1 are initially fed via two manual input stations 5 into the sorting machine. The presorted mail items 2 are supplied via an automatic input station 6 and a bar code reader 4 to the machine. As a result, a high flow rate is possible and the time for supplying unsorted and presorted mail items can be controlled easily.

When sorting standard letters, it is favorable in this connection if a double material input is used. The unsorted letters are fed in on one side and the presorted letters on the other side. An address reader, a bar code printer and a bar code reader follow the double material input. If an unsorted letter is input, the address reader and the bar code printer are active, whereas only the bar code reader is active for a presorted letter.

What is claimed is:

1. A method of sorting mail having a number of final destinations comprising the steps of:

presorting mail according to a first plan where said mail is directed into one of a first plurality of separations racks;

sorting mail according to a second plan where mail in one of said first plurality of separation racks is sorted into one of a second plurality of separation racks; and performing the steps of presorting and sorting substantially in concert, on a single apparatus, wherein the number of final destinations for said mail is greater than the combined number of said first and second plurality of separation racks.

2. The method according to claim 1, wherein said number of final destinations comprises a product of said combined number of said first and second plurality of separation racks.

3. The method according to claim 1, further comprising the steps of:

during said step of sorting, affixing a label to said mail, said label indicative of said one of the second plurality of separation racks;

reading said label; and using an output of said step of reading to direct said mail.

4. The method according to claim 3, wherein said label is a bar code and said reading is performed by a bar code reader.

5. The method according to claim 1, wherein said first plurality of separation racks comprises up to 5 separation racks and said second plurality of separation racks comprises up to 200 separation racks.

6. The method according to claim 1, wherein said step of sorting is performed according to a mail address.

7. The method according to claim 1, wherein said step of sorting is performed according to the frequency of mail to at least one of said second plurality of separation racks.

8. The method according to claim 1, further comprising the steps of:

determining whether mail has been labeled;

presorting said mail if said mail is not labeled; and sorting said mail if said mail is labeled.

9. An apparatus for sorting mail having a number of final destinations comprising:

first processing means for presorting said mail according to a first plan;

a first plurality of separation racks for receiving presorted mail;

second processing means for sorting said mail according to a second plan;

a second plurality of separation racks for receiving mail sorted from said first plurality of separation racks according to said second plan; and means for directing mail from said second plurality of separation racks to a final destination, where the number of final destinations is greater than the combined number of said first and second plurality of separation racks.

10. The apparatus according to claim 9, wherein said number of final destinations comprises the product of said combined number of first and second plurality of separation racks.

11. The apparatus according to claim 9, wherein said second processing means comprises a labeler for affixing a label on said mail, said label indicative of one of said second plurality of separation racks; and means for conveying said mail to said one of said second plurality of separation racks.

12. The method according to claim 11, wherein said label comprises a bar code label and said reader comprises a bar code reader.

13. The apparatus according to claim 9, further comprising first and second entry means; said first entry means directing mail to said first processing means and said second entry means directing mail to said processing means.

* * * * *